US007207925B2

(12) United States Patent
Moon

(10) Patent No.: US 7,207,925 B2
(45) Date of Patent: Apr. 24, 2007

(54) COMPACT ELLIPTICAL EXERCISE MACHINE WITH ADJUSTABLE STRIDE LENGTH

(75) Inventor: Daniel R Moon, Riverside, IL (US)

(73) Assignee: True Fitness Technology, Inc., O'Fallon, MO (US)

( * ) Notice: Subject to any disclaimer, the term of this patent is extended or adjusted under 35 U.S.C. 154(b) by 1 day.

(21) Appl. No.: 11/185,955

(22) Filed: Jul. 20, 2005

(65) Prior Publication Data

US 2007/0021274 A1 Jan. 25, 2007

(51) Int. Cl.
*A63B 69/16* (2006.01)
*A63B 22/64* (2006.01)

(52) U.S. Cl. ..... 482/52; 482/57; 482/70

(58) Field of Classification Search ..... 482/51, 482/52, 57, 70, 79–80
See application file for complete search history.

(56) References Cited

U.S. PATENT DOCUMENTS 4,786,050 A 11/1988 Geschwender
5,893,820 A * 4/1999 Maresh et al. ..... 482/51
6,045,488 A * 4/2000 Eschenbach ..... 482/52
6,176,814 B1 * 1/2001 Ryan et al. ..... 482/51
6,183,398 B1 * 2/2001 Rufino et al. ..... 482/57
6,648,800 B2 * 11/2003 Stearns et al. ..... 482/52
6,689,019 B2 * 2/2004 Ohrt et al. ..... 482/52
6,835,166 B1 12/2004 Stearns et al.
6,994,656 B2 * 2/2006 Liao et al. ..... 482/52

* cited by examiner

*Primary Examiner*—Stephen R. Crow
(74) *Attorney, Agent, or Firm*—Lewis, Rice & Fingersh, L.C.

(57) ABSTRACT

An elliptical exercise machine and methods for using the machine where the horizontal length of the stride of the ellipse can be adjusted by the user without the user having to alter the vertical dimension of the ellipse by an equivalent amount. The machine provides for alteration from a rocker bar's distal end following a cam track, whose position is adjustable. The machine may allow for this adjustment to occur during the performance of an exercise routine.

19 Claims, 8 Drawing Sheets

COMPACT ELLIPTICAL EXERCISE MACHINE WITH ADJUSTABLE STRIDE LENGTH

BACKGROUND

1. Field of the Invention

This disclosure relates to the field of elliptical exercise machines. In particular, to elliptical exercise machines which allow for alteration in the shape of the foot path.

2. Description of the Related Art

The benefits of regular aerobic exercise on individuals of any age is well documented in fitness science. Aerobic exercise can dramatically improve cardiac stamina and function, as well as leading to weight loss, increased metabolism and other benefits. At the same time, aerobic exercise has often been linked to damaging effects, particularly to joints or similar structures where the impact from many aerobic exercise activities can cause injury. Therefore, those involved in the exercise industry are continuously seeking ways to provide users with exercises that have all the benefits of aerobic exercise, without the damaging side effects.

Most low-impact aerobic exercises have traditionally been difficult to perform. Many low-impact aerobic exercises (such as those performed in water) traditionally require performance either outside or at a gym. Cold weather, other undesirable conditions, and cost can make these types of aerobic exercise unobtainable at some times and to some people. In order to allow people to perform aerobic exercises without having to go outside or to gyms or the like, fitness machines have been developed to allow a user to perform aerobic exercises in a small area of their home.

Many of these machines, however, are either too physically demanding on the user, or too complicated to use. In either case, the machine often falls into disuse. Recently, a class of machines which are referred to as "elliptical machines" or "elliptical cross-trainers" have become very popular due to their ease of use and their provision of relatively low-impact aerobic exercise.

Generally in these types of machines, a user performs a motion using their legs that forces their feet to move in a generally elliptical motion about each other. This motion is designed to simulate the motion of the feet when jogging or climbing but the rotational motion is "low-impact" compared to jogging or climbing where the feet regularly impact a surface. In an elliptical machine, a user uses a fairly natural motion to instead move their feet through the smooth exercise pattern dictated by the machine. This motion may also be complemented by them moving their arms in a reciprocating motion while pulling or pushing various arms on the machine whose motion is connected to the motion of the feet, and vice-versa.

Currently, the biggest problem with elliptical machines is that the dimensions of the elliptical pathway followed by the user's feet are generally severely limited in size and shape by the design of the machine. The elliptical pathway generated by these machines is often created by the interaction of a plurality of different partial motions, and attempts to alter the motion of a user in one dimension also alters the motion in another. It is desirable that users have the option to arrange the machine so that the ellipse can be tailored to fit their stride and to change during the exercise, but with machines on the market today, that generally is not possible.

The problem is most simply described by looking at the elliptical motion the feet make when using an elliptical exercise machine. This elliptical motion can be described by the dimensions of the ellipse. Since a user generally stands upright on an elliptical machine, the user's feet travel generally horizontally relative to the surface upon which the machine rests. This represents the user's stride length or how far they step. Further, the user's feet are raised and lowered relative to the surface as they move through the ellipse. This is the height to which the user's feet are raised. How a user steps depends on the type of action they are performing. A more circular ellipse will often correspond more to the motion made while climbing, while a slightly more elongated ellipse is more akin to walking, and a significantly elongated ellipse can be more akin to the motion of running.

As a user's speed on the machine increases or decreases, as the resistance imparted by the machine increases or decreases, or simply based on the size of the user, it can be desirable for the machine to alter the type of stride the user is making (by elongating or shortening the stride) to better correspond to a more natural movement. This allows the user to move through a range of different activities during an exercise session, providing for a beneficial workout.

In elliptical machines currently, the size and shape of the ellipse is generally fixed by the construction of the machine. That is, the footrests (the portion of an elliptical machine that will traverse the same ellipse as the user's feet) are generally forced to proscribe only a single ellipse when the machine is used and that ellipse is generally unchangeable. Some machines allow for some alteration of this ellipse, but generally those machines increase both dimensions of the ellipse, not just the horizontal component. That is, the user can adjust the total size of the ellipse, but the ratio of the ellipse's components remains relatively constant.

This arrangement means that many users are not comfortable with the stride of an elliptical machine as it is either too long or too short for their stride. Even if the stride is adjustable, the user may still be uncomfortable. For some users, the stride will be much too short compared to their normal stride and attempts to increase the stride length result in their feet being raised uncomfortably high (e.g. turning a walking or jogging exercise motion into more of a climbing motion), while for others the same machine's stride can be much too long (resulting in overstretching of their legs as if they are running all the time). Further, a user may desire to tailor the machine's motion for the general type of exercise they want to perform (e.g., more jogging motion or more climbing motion) and may wish to alter the motion during an exercise session to have a more varied workout.

SUMMARY

Because of these and other problems in the art, described herein, among other things, are elliptical exercise machines where the length of the horizontal dimension (stride) of the ellipse can be adjusted by the user independent of altering the vertical dimension of the ellipse by an equivalent amount. This is generally referred to as having an "adjustable stride length" in the elliptical machine. Further, the machines described herein are generally intended to allow for alteration of the stride length during the exercise or "on-the-fly" so that a user can vary their stride length throughout an exercise to make the exercise more comfortable and to provide for a more varied workout.

Described herein there is, an elliptical exercise machine comprising: a frame; at least two crankshafts rotationally connected to the frame; a rail attached to the crankshafts so that the rail traverses a path in conjunction with the rotation of the crankshafts; a footskate capable of reciprocating motion on the rail; a cam track, the track describing a path;

a rocker arm, the rocker arm being arranged to oscillate about a first axis through a first angular distance as the crankshafts rotate, the rocker arm having a distal end wherein the distal end traverses the path as the rocker arm oscillates; and an adjustment arm, the adjustment arm connected to the rocker arm such that the adjustment arm moves through a second angular distance as the rocker arm oscillates, the second angular distance being related to the first angular distance; wherein, the adjustment arm is operationally attached to the footskate via an interface located toward the distal end of the adjustment arm in a manner so that reciprocation of the adjustment arm through the second angular distance provides the reciprocating motion to the footskate; wherein the cam track is moveable; and wherein movement of the cam track between two different positions alters the first angular distance.

In an embodiment of the machine, the movement of the cam track is rotation of the cam track about a second axis spaced from the first which may be on the path.

In an embodiment of the machine, the rocker arm is a sideways pendulum and the adjustment arm is an upright pendulum.

In an embodiment of the machine there is included an adjustment mechanism for moving the cam track between the two positions which may be electrically powered, hand powered, a worm screw, or a hydraulic cylinder.

In an embodiment of the machine, at least one of the crankshafts is attached to a flywheel or a resistance device. A computer may be used to control the machine such as by controlling the resistance device and the adjustment mechanism.

In an embodiment of the machine at least one of the crankshafts includes a wheel and an offset pin, the offset pin being rotationally connected to a drive link; the drive link being operatively connected to the rocker arm such that: rotation of the wheel causes the drive link to reciprocate which in turn causes the rocker arm to oscillate.

In an embodiment of the machine, the position of the rail, at any selected point of rotation, is parallel to the position of the rail at any other selected point of rotation or the cam track may be moved by translation, such as, but not limited to, linear translation, of the cam track toward and away from the first axis.

There is also described herein, a method of altering the stride length of an elliptical exercise machine during an exercise, the method comprising: providing an elliptical exercise machine; the machine including: a frame; at least two crankshafts rotationally connected to the frame; a rail attached to the crankshafts so that the rail traverses a path in conjunction with the rotation of the crankshafts; a footskate capable of reciprocating motion on the rail; a cam track, the track describing a path; a rocker arm, the rocker arm being arranged to oscillate about a first axis and through a first angular distance as the crankshafts rotate, the rocker arm having a distal end wherein the distal end traverses the path as the rocker arm oscillates; and an adjustment arm, the adjustment arm connected to the rocker arm such that the adjustment arm moves through a second angular distance as the rocker bar oscillates, the second angular distance being related to the first angular distance; having a user exercise on the elliptical exercise machine; attaching the adjustment arm to the footskate via an interface located toward the distal end of the adjustment arm in a manner so that reciprocation of the adjustment arm through the second angular distance provides the reciprocating motion to the footskate; and changing the position of the cam track during the exercise.

BRIEF DESCRIPTION OF THE DRAWINGS

FIG. 4 shows a detail view of the crankshafts. FIG. 4A shows the front crankshaft while

FIG. 5 shows the embodiment of FIG. 2 positioned for two different stride lengths. FIG. 5A is a short stride length, while

DESCRIPTION OF PREFERRED EMBODIMENT(S)

Although the machines, devices, and methods described below are discussed primarily in terms of their use with a particular layout of an elliptical exercise motion machine utilizing two rotational crankshafts and handgrip pendulum arms, one of ordinary skill in the art would understand that the principles, methods, and machines discussed herein could be adapted, without undue experimentation, to be useable on an elliptical motion machine which generates its elliptical motion through the use of other systems.

The invention disclosed herein primarily relates to elliptical exercise machines where a reciprocating footskate which traverses a fixed linear portion of a rail is replaced by a system where the linear traversal is adjustable during an exercise to allow for quick and convenient alteration of the horizontal stride length of the user utilizing the machine, without significantly altering their vertical stride height on the machine.

For the purposes of this disclosure, the terms horizontal and vertical will be used when referring to the dimensions of the ellipse drawn by the user's feet. One of ordinary skill in the art will understand that depending on the arrangement of the parts and how the machine is used, the ellipse traversed by the user's feet may be at an angle to the vertical and horizontal. That is, a line connecting the two axes of the ellipse may not be completely horizontal or completely vertical, or in some cases it may be. For the purposes of this disclosure, when the horizontal dimension of the ellipse is referred to, it is referring to the longest dimension of the ellipse (line through both axes), and the vertical dimension is the shortest dimension of the ellipse (line evenly spaced between the two axes). These dimensions are not used to strictly mean horizontal and vertical relative to the earth. Further, most of this discussion will refer to the operation of a single side of an exercise machine, one of ordinary skill in the art would understand that the other side will operate in a similar manner.

Further, while the system discusses elliptical motion, it should be recognized that that term, as is used in the art of exercise machines, does not require the foot of the user to traverse a true ellipse, but that the foot of the user traverses a generally elliptical or similar rotational shape. The shape will generally not be circular, but may be circular, oval, elliptical, in the shape of a racetrack, kidney-shaped, or in any other shape having a relatively smoothly curving perimeter with a horizontal and vertical component of movement.

Figure 1:
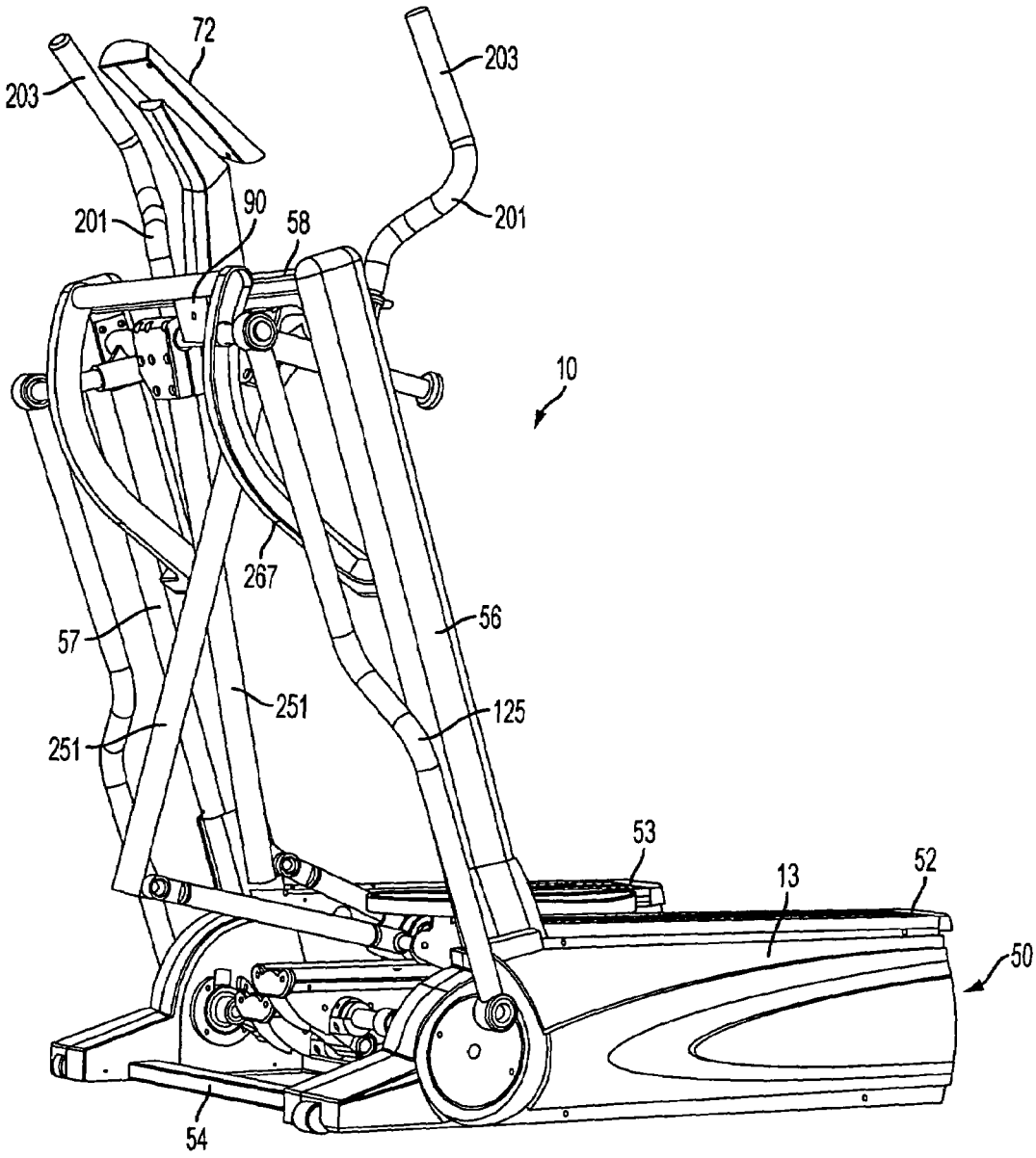
FIG. 1 shows a front perspective view of an embodiment of a compact exercise machine with adjustable stride length with the frame cover in place.

FIG. 1 depicts an embodiment of a compact elliptical motion exercise machine (10) including an adjustable stride length of the type that may be adjusted during the exercise. The exercise machine (10) is comprised of a frame (50) of generally rigid construction which will sit stably on a surface to provide for the general shape of the machine (10) as shown in FIG. 1. The frame (50) is generally constructed of strong rigid materials such as, but not limited to, steel, aluminum, plastic, or any combination of the above. The frame (50) may be of any shape, but will generally be designed to provide a place to attach the remaining components and to provide a structure which can resist damage or breakage from repeated use by the individual exercising thereon. The frame (50) will also be designed so as to stably support a user utilizing the exercise machine (10) and prevent the machine from having undue sway or other undesirable motion while the user is exercising. In the depicted embodiment, frame (50) includes three major substructures, left and right main supports (52) and (53), crossbeams (54), and vertical riser beams (56) and (57).

The main supports (52) and (53) will generally rest on the surface upon which the exercise machine (10) is placed. This surface will generally be flat. One of ordinary skill in the art would understand that the surface need not be flat as the position of the machine (10) is only important relative to the user but, for clarity, this disclosure will presume that the machine (10) is placed on a generally flat surface. The main supports (52) and (53) are then held at a position spaced apart from each other by the crossbeams (54). There may be any number of crossbeams and the depicted number of four is by no means required. The vertical riser beams (56) and (57) extend generally away from the surface on which the machine (10) is resting and extend from the main supports (52) and (53) at a point usually toward the front of the frame (50). The vertical riser beams (56) and (57) are topped by a top crossbeam (58) which may have attached thereto a computer control panel (72) for controlling the functions of the machine (10) as known to those of ordinary skill in the art.

The top crossbeam (58) may have additional uses from simply supporting the computer control panel (72). In particular, the top crossbeam (58) may be used to support the user's hands during exercising if they do not wish to utilize the exercise arms (201). Still further, the adjustment mechanism (90), which is discussed in detail later, may be attached to the top crossbeam (58) in a central location. This attachment provides for a simplified mechanism for adjusting the position of the cam rotator (267).

In an embodiment, the frame (50) may include additional components, or not include any of the above components. Further, any portion of the frame (50) may be covered by a cover (13) as shown in FIG. 1 which may not provide for specific strength and support of the other components of the machine (10), but may serve to cover operating or moving parts of the machine (10) for aesthetic or safety purposes such as to keep an individual's clothing from becoming trapped in the machine (10) or simply to give the machine a particular "look."

Figure 2:
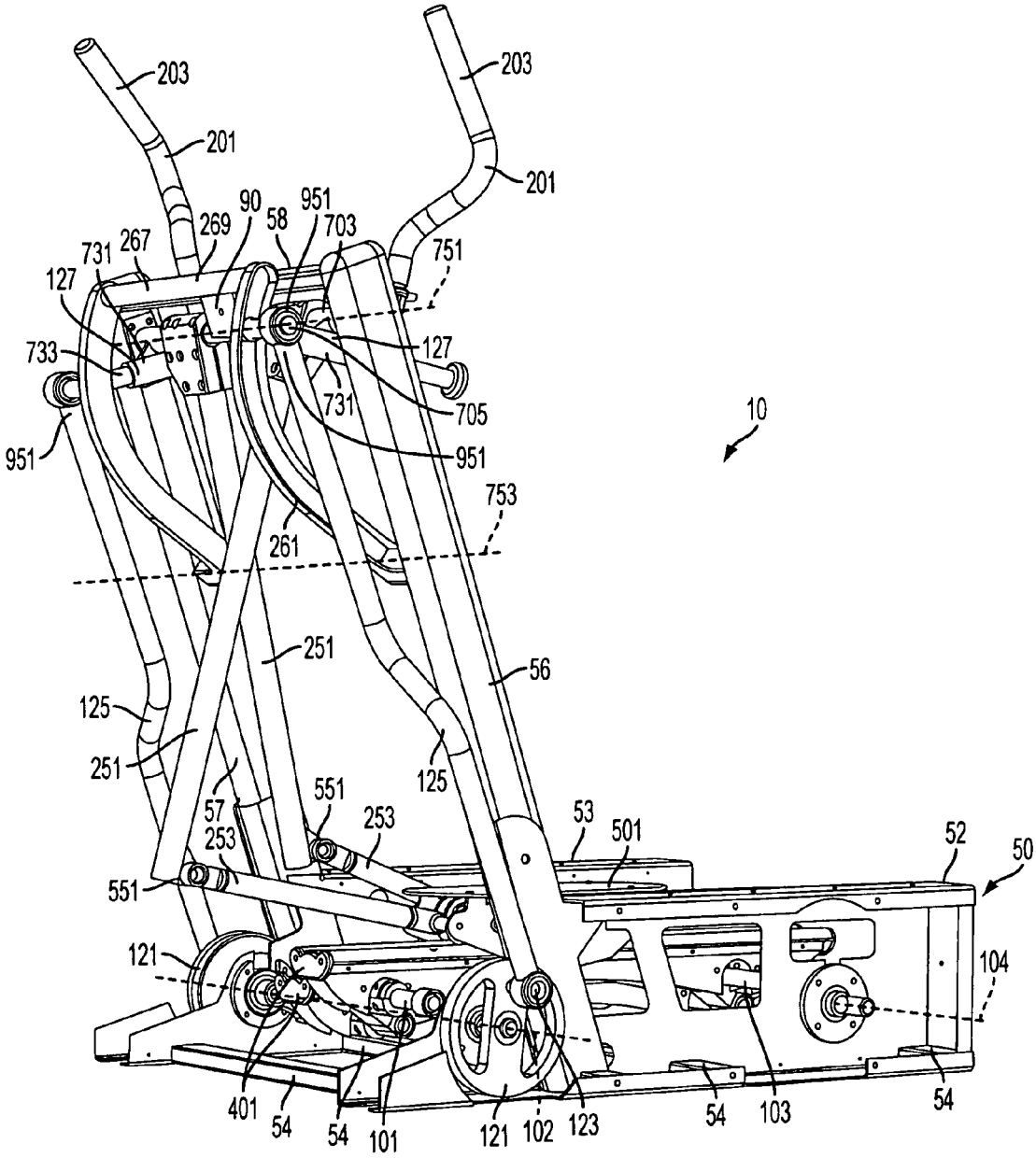
FIG. 2 shows the embodiment of FIG. 1 with the cover removed.
Figure 3:
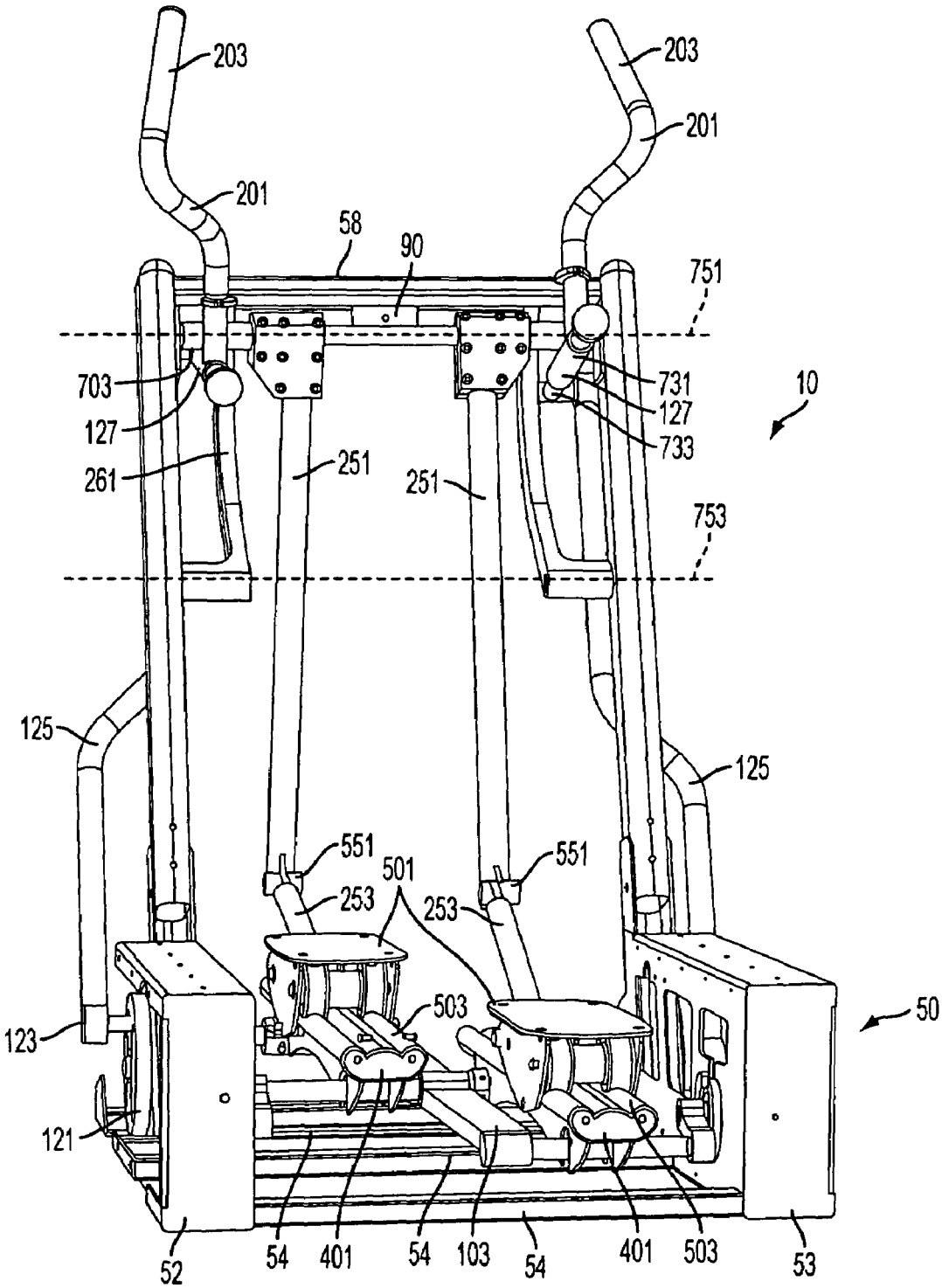
FIG. 3 shows a rear perspective view of the embodiment of FIG. 2

FIGS. 2 and 3 show various views of the frame (50) with the cover (13) removed so that internal parts are visible. Attached between the main support beams (52) and (53) are a pair of crankshafts (101) and (103). The front crankshaft (101) is arranged toward the front of the machine (10) while the rear crankshaft (103) is arranged toward the rear. Front and rear are arbitrarily assigned, but relate to the user's usual facing when using the exercise machine (10). Each crankshaft (101) and (103) rotates relative to the frame (50) about a central axis (102) and (104) as is best seen in the depiction of the crankshafts (101) and (103) shown in FIG. 4. On the front crankshaft (101), there is a wheel (121) attached at each end which will rotate in conjunction with the rotational motion of the front crankshaft (101). The crankshaft (101) or (103) will be attached to the frame (50) through bearing assemblies around the axial portions (113) of the crankshaft (101) or (103).

Figure 4A:
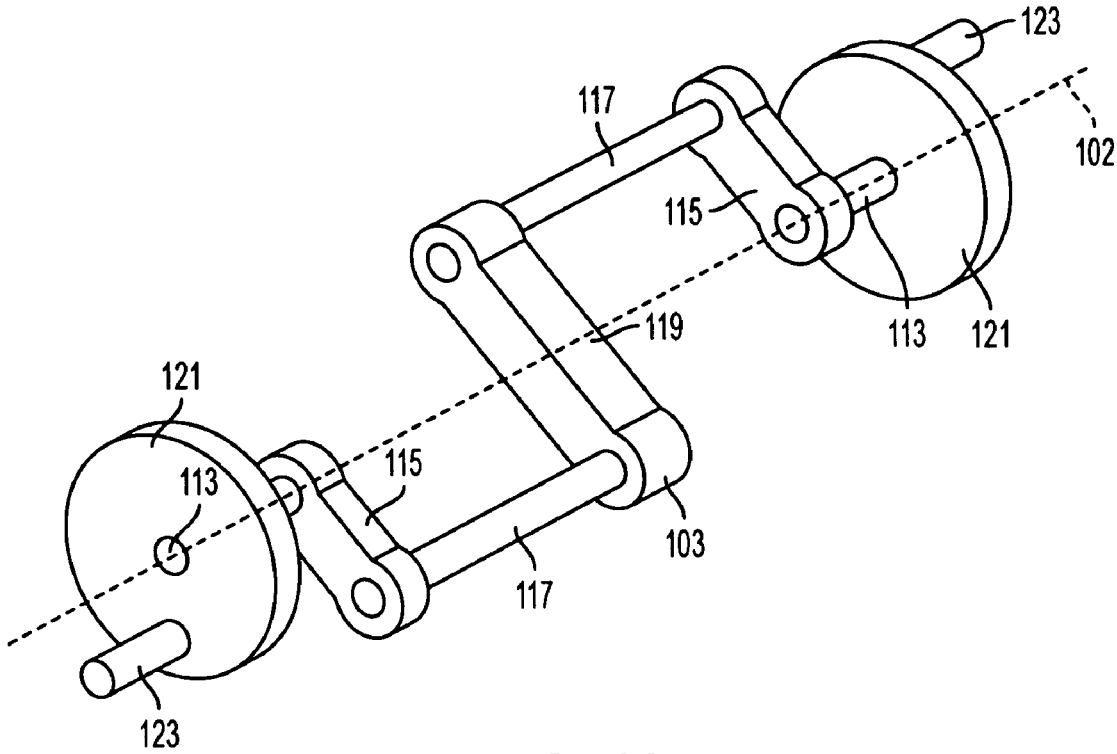
Figure 4B:
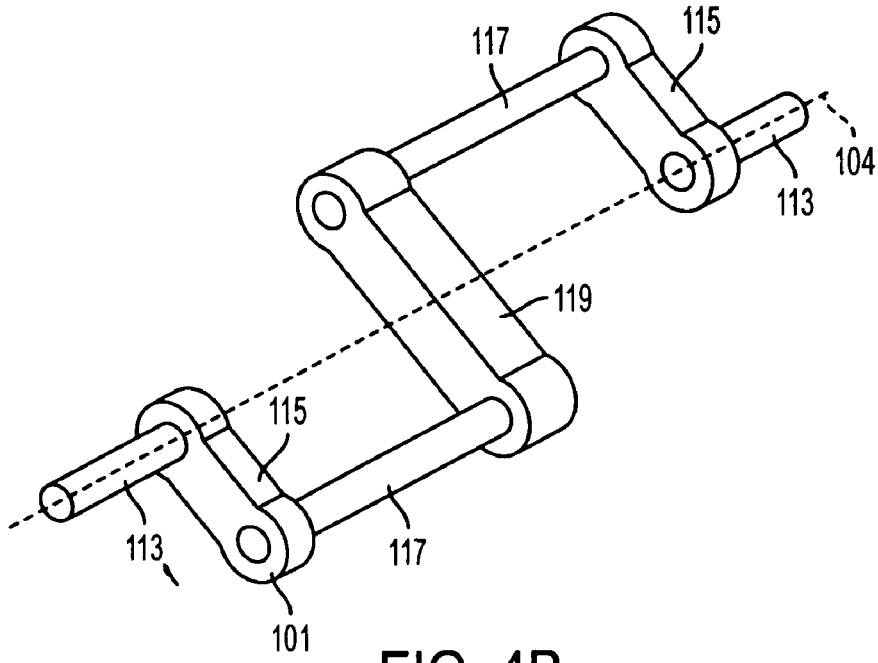
FIG. 4B shows the rear.

Turning back to FIG. 4 and the front crankshaft (101), the front crankshaft (101) comprises the axial portions (113) of the shaft, two crank arms (115) which are generally 180 degrees separated, two crank pins (117), each of which is arranged generally parallel to the axis of rotation of the crankshaft (101), and a connecting web (119) between the two crank pins (117). The resultant design of crankshaft (101), therefore, has the two crank pins (117) arranged generally 180 degrees out of phase with each other. The rear crankshaft (103) as shown in FIG. 4B will generally have a similar arrangement of axial portions (113), crank arms (115), crank pins (117) and connecting web (119). The remaining structure of the rear crankshaft (103) will, however, be different in most cases as various components need only interact directly with one of the crankshafts.

Attached towards the ends of the axial portions (113) of the front crankshaft (101) is a wheel (121). Each wheel (121) has attached thereon an offset pin (123) which is arranged at a distance from the center of rotation of the wheel (121) to which it is attached. The offset pin (123) on the left side of the machine (10) will be arranged so as to be at a position generally 180 degrees different from the offset pin (123) on the right side of the machine (10) at any given time. Further, the offset pin (123) will generally be arranged to "trail" the rotation of the associated crank pin (117) (that is the crank pin (117) on the left side on the machine (10) for the offset pin (123) on the left side of the machine (10)) about 60 degrees when the crankshafts (101) and (103) are rotated in their forward direction.

Each of these offset pins (123) is attached to a drive link (125) which will extend from the pin (123) upward to a rocker arm (127). The rocker arm (127), is attached via a rotational connection about a first axis (751) at a point upward on the vertical riser (56) and (57). Therefore, as the front crankshaft (101) rotates in the generally forward direction, the wheel (121) rotates with the crankshaft (101) and causes the offset pin (123) to rotate in a continuous circle. As the offset pin (123) rotates, the drive link (125) will generally cause the rocker arm (127) to oscillate through a portion of an arc about the first axis (751). The arc portion will generally be arranged to be principally vertical, that is, if a circle is drawn through the specific angle the net vertical displacement created by movement through the angle is larger than the net horizontal displacement. In alternative terminology, the rocker arm (127) preferably forms a sideways pendulum.

Attached to the rocker arm (127) is an exercise arm (201). The exercise arm (201) will generally include a handgrip (203). Also attached to the rocker arm (127) is an adjustment arm (251). Both portions will generally be rigidly attached both to each other and to the rocker arm (127) so as to move as a unit. The hand grip (203) at the top of the exercise arm (201) generally moves in a vertically arranged arc segment. This handgrip (203) is designed to be grasped by a user and can be used to help exercise the arms and to drive the motion of the crankshafts (101) and (103).

In operation, the two crankshafts (101) and (103) are preferably placed in the frame (50) in such a manner that they are rotating at a similar relative position. That is, the crank pin (117) on the right side of the front crankshaft (101) is in the same arcuate position as the crank pin (117) on the right side of the rear crankshaft (103) at any instant in time. This arrangement is what is depicted in FIGS. 1 through 3 and provides that each of the rails (401), which are arranged to be attached simultaneously to both the same side crank pins (117) of both crankshafts (101) and (103), will move in a pattern whereby the rails (401) are parallel to their position at any other time during rotation. This arrangement is not, however, required, and in an alternative embodiment, the crankshafts (101) and (103) are placed to be slightly out of phase with each other. If placed out of phase, the rails (401) will perform a levering motion about a central pivot point as the crankshafts (101) and (103) rotate.

The two same side crank pins (117) on the crankshafts (101) and (103), as discussed above, are each connected by a rail (401). The rail (401) is attached to the appropriate crank pin (117) toward the similar end of the rail (401) through a support pivot (403). The support pivot (403) provides a single axis of rotation relative to each of the crankshafts (101) and (103) and allows the rail (401) and the crank pin (117) to freely rotate about each other at that axis of rotation. As the crankshafts (101) and (103) are connected by the rails (401), it should be apparent that as each of the crankshafts (101) and (103) moves through the circle of rotation, the rails (401) force the other of the crankshafts (101) and (103) to move through the circle at a similar rate. Still further, any point on either rail (401) transcribes a circle at the same time that each of the crank pins (117) transcribes a circle. The two crankshafts (101) and (103) are therefore arranged to operate in simultaneous rotational position. Further, due to the design of the crankshafts (101) and (103), the two rails (401) will be essentially arranged to rotate 180 degrees out of phase with each other.

As the crankshafts (101) and (103) transcribe the circle moving the rails (401) through circles, the front crankshaft (101) will turn the wheels (121), which will, in turn, cause the adjustment arms (251) to reciprocate. By placing the user's feet directly on the rails (401), the user will be able to exercise with the machine (10) with their feet transcribing circular motion in a constantly parallel position. This circular motion may be made elliptical by providing a footskate (501) which will slide on the rail (401) at a particular rate related to the instantaneous position of the rail (401). Such sliding motion allows for alteration of the travel path from that of a circle to one approaching an ellipse. Traditionally, this elliptical motion was provided in a fixed fashion. One such arrangement of components is shown in U.S. Pat. No. 6,835,166, the entire disclosure of which is herein incorporated by reference.

In addition to providing the basic rotational motion to the footskates (501), the crankshafts (101) and (103) may also additionally operate on other components to provide for additional functionality in the exercise machine (10). As shown in FIGS. 4A and 4B, the front crankshaft (101) may turn a front sprocket (not shown) which is connected to one axial portion (113) thereof. The front sprocket (141) in turn is connected to a chain (not shown) or other synchronization device such as, but not limited to, a connecting rod, which is connected between the front sprocket and to a rear sprocket (not shown) which is attached to the rear crankshaft (103) at a similar axial portion (113). The rotation of the chain about the sprockets can further help to maintain synchronicity in the movement of the two crankshafts (101) and (103) by allowing the motion of one crankshaft (101) or (103) to be translated to the other crankshaft (101) or (103). This can supplement the rails' (401) translation of motion from one crankshaft (101) or (103) to the other and help maintain synchronicity.

There may also be included a variety of other components as is known to those of ordinary skill in the art for improving exercise motion upon which at least one of the crankshafts (101) or (103) interacts. For example, the wheel (121) or another wheel on either crankshaft (101) or (103) may be connected to a flywheel (not shown) by means of a belt (not shown) so as to provide for more fluid and smooth motion of the rails (401) as the crankshafts (101) and (103) are rotated and the pendulum arms (201) are reciprocated. The inclusion of such a flywheel (321) is well known to those of ordinary skill in the art and allows for the storage of inertial energy so that once the rails (401) have begun to rotate, the rotation is maintained in a smooth fashion.

Further, there may be a resistance device (not shown) included to provide for resistance to the motion of the wheel (121) and therefore to increase the difficulty of the exercise. In an embodiment, the resistance device comprises a friction belt which serves to resist the rotation of the wheel (121). As the belt is tightened on the wheel (121), the amount of force required to move the wheel (121) (and to maintain its steady rotation) is increased providing for a more difficult exercise. This design of resistance device is by no means required, however, and any type of resistance device, including but not limited to, friction devices, electromechanical devices, pneumatic or hydraulic devices, or a combination of devices may be used to provide resistance.

While not shown, the exercise machine (10) may also include an electric drive or electric assist mechanism. While the exercise motion preferably uses motion of the arms and legs of the user to drive the crankshafts (101) and (103) through their desired motion as the provision of exercise, it is recognized that in some cases, a user may lack the requisite strength to commence the exercise or to comfortably perform it. Such an assistance mechanism for use in conjunction with arm driven treadmills, which could be adapted for use with this elliptical machine (10), is shown in U.S. Patent Application No. 60/613,661, the entire disclosure of which is herein incorporated by reference.

As discussed above, so as to provide for elliptical instead of circular motion of the user's foot, each of the rails (401) has located thereon a footskate (501) which is arranged to reciprocate on a foot track (503) which is located on the rail (401). The reciprocating relationship may be accomplished by any mechanism known to those of ordinary skill in the art including sliding or rolling relationships. In the depicted embodiment, the footskate (501) includes a series of wheels (511) which roll on the foot track (503) as depicted. In the depicted embodiment, the adjustable motion is accomplished by the inclusion of an adjustment arm (251) connected via a transfer arm (253) attached toward the distal end (551) of adjustment arm (251) to the front of the footskate (501) and a cam track (261) in which an end of the rocker arm (127) travels. The adjustment arm (251) is reciprocated in a standard pendulum motion by the action of the rocker arm (127) and the arc through which it travels is determined by the positioning of the cam track (261).

To understand the motion imparted to the footskate (501) and how to adjust that motion, it is best to begin generally with a particular position of the cam track (261) which is best seen by examining FIGS. 5 through 8. As discussed previously, as the front crankshaft (101) rotates, motion is translated to the rocker arm (127) so as to make it oscillate as a sideways pendulum. The motion of the rocker arm (127) is translated to the adjustment arm (251) which is attached thereto. The adjustment arm (251) is generally rigidly attached to the rocker arm (127) such as by welding the adjustment arm (251) to the rocker arm (127) or by bolting the adjustment arm (251) securely to an axial tube (703) which is in turn attached rigidly to the rocker arm (127) as shown in FIG. 3. The adjustment arm (251) therefore rotates in conjunction with the rocker arm (127) about a common axis of rotation. That common axis of rotation is the first axis (751). Because of this relationship, the angular distance transcribed by the rocker arm (127) is generally directly related to the angular distance transcribed by the adjustment arm (251). That is, if the rocker arm (127) moves through an angle of X in conjunction with a single rotation of the wheel (121), the adjustment arm (251) also moves through an angle of X in conjunction with a single rotation of the wheel (121). As can be seen from the FIGS., however, the adjustment arm (251) is quite a bit longer than the rocker arm (127) and therefore the distal end (705) of the rocker arm (127) will transcribe a shorter distance than the distal end (551) of the adjustment arm (251).

As should also be apparent from the FIGS, the adjustment arm (251) is generally arranged so as to be at an angle from the rocker arm (127), which may be any angle, but is depicted as being around 75–120 degrees. In this fashion, if the arc traversed by the rocker arm (127) is generally vertical in arrangement (that is the vertical component is greater than the horizontal component), the opposite is true of the adjustment arm (251) and the horizontal component is greater than the vertical component. The adjustment arm (251) generally reciprocates in upright pendulum motion.

The rocker arm (127) has a distal end (705) which is designed to follow the cam track (261). The distal end (705) will generally be moveable relative to the first axis (751). That is, the rocker arm (127) is of adjustable length. In the depicted embodiment, the adjustable length comprises the rocker arm (127) being made of an outer sleeve (731) and an internal floating piston (733) which can freely move within the outer sleeve (731). The cam track (261) is generally a smooth arc of any shape including a semi circle, a parabolic arc, a hyperbolic arc, or any other smooth arcuate shape. In a still further embodiment, the cam track (261) can provide a linear path.

Figure 6:
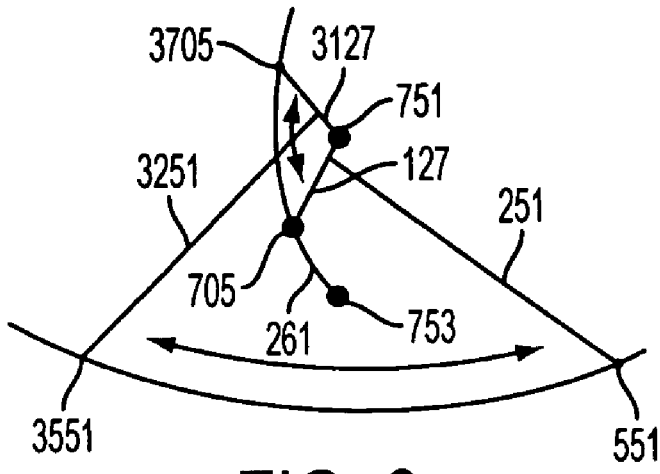
FIG. 6 shows a general diagram indicating motion along the cam track in a first position.
Figure 7:
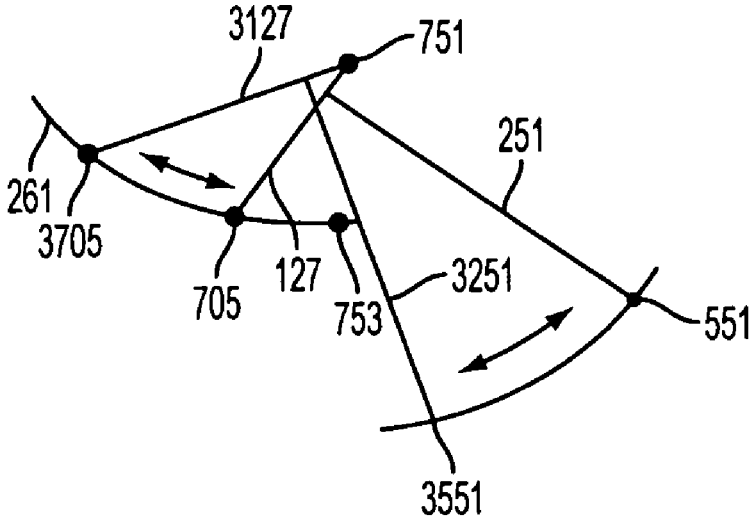
FIG. 7 shows a general diagram indicating motion along the cam track in a second position.

FIGS. 6 and 7, in combination, demonstrate the relationship of the motion of the rocker arm (127) to the adjustment arm (251) with different positioning of the cam track (261). A first position is indicated by regular numbers, while the second is indicated by numbers starting with 3. For example, the rocker arm moves from position (127) to position (3127). The cam track (261) is generally a fixed shape and will not change shape during its movement. In FIGS. 6 and 7, the cam track (261) is made in a semi circular shape for illustration, but that shape is by no means required and any smooth arc or linear design can be used. The cam track (261) provides an arcuate track generally designed to be convex relative to the first axis (that is, the center point of the cam track's (261) arc is further from the frame than the two end points are). As shown in FIGS. 6 and 7, the cam track (261) is used to adjust the angular distance the rocker arm (127) transcribes during a single rotation of the wheel (121). The motion is altered by moving the cam track (261) either toward or away from the first axis (751). In the depicted embodiment, this is by rotating the cam track about a second axis (753) separated from the first axis (751). In the depicted embodiment, the second axis (753) is on the arc transcribed by the cam track (261) and while this is preferred, it is by no means required. Instead, the second axis (753) may be anyplace. Generally, the second axis (753) will be below the first axis (751). In an alternative embodiment, the cam track (261) need not be rotated about the second axis of rotation, but can be translated toward and away from the first axis (751) whether linearly or otherwise.

The placement of the cam track (261) serves to provide for the arcuate motion and resultant angular motion of the rocker arm (127). As the drive link (125) is a fixed length and the rotation of the wheel (121) is fixed, the total displacement of the proximal end (951) of the drive link (125) is fixed. The proximal end (951) of the drive link (125) will therefore generally transcribe an equal length of the cam track (261) regardless of the position of the cam track (261). Therefore, the position of the cam track (261) serves to translate that fixed distance into differing angular rotations. The cam track (261), as defining a path in two directions, can be moved relative to the first axis (751) so as to position the cam track (261) so that any particular arc length can result in movement of the rocker arm (127) through larger or smaller angles. As can be seen in FIG. 6, if the cam track is arranged "nearer" with the first axis, the rocker arm (127) will rotate through a greater angle. Alternatively, if the cam track (261) is placed in the position of FIG. 7, where it is further from the first axis (751), the rocker arm (127) moves through a smaller angle, but the piston will generally extend and retract a greater amount. In the translation embodiment, the radius of the rocker arm's movement is simply increased, causing the angle to decrease.

Figure 8:
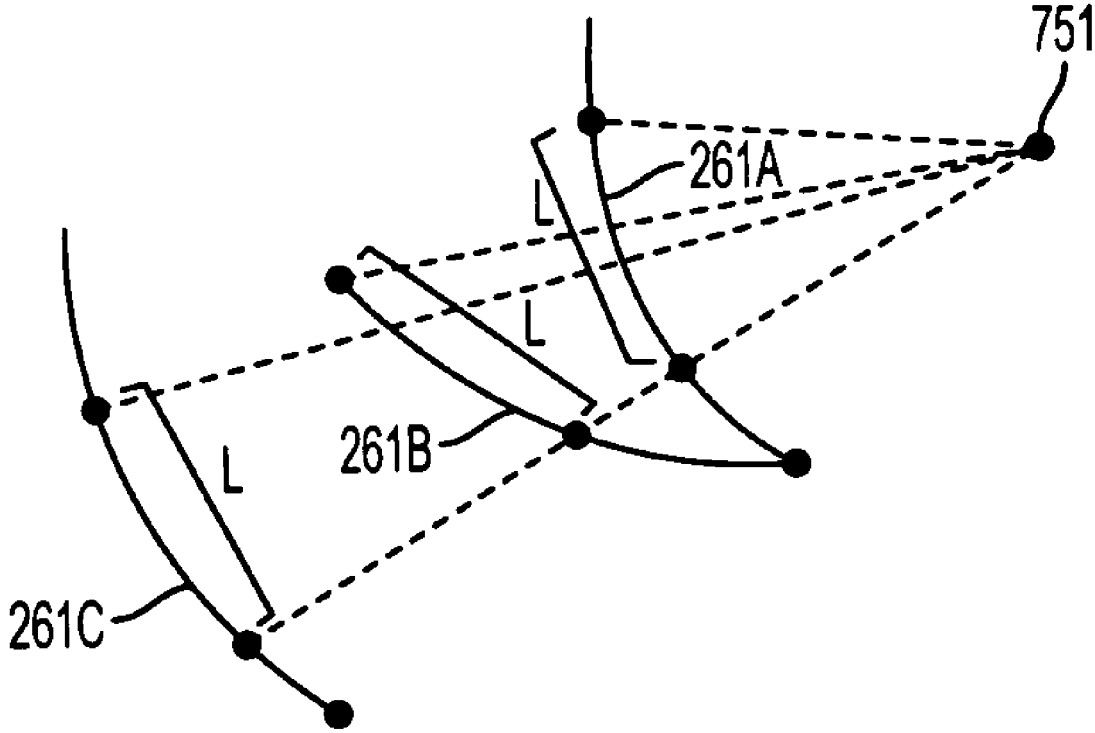
FIG. 8 shows the arc traversed by the distal end of the rocker arm with various positions of the cam track

The relationship here should be apparent. Placing the cam track (261) closer to the first axis (751) will generally result in a larger angle that the rocker arm (127) moves through. It should be noted that the cam track being "nearer" to the first axis does not require all points to be nearer, as in the depicted embodiment the bottom points of the cam track are at the second axis (753) and are immobile relative to the first axis (751). The concept is generally shown in FIG. 8 which illustrates how various different positions of the cam track (261A), (261B), and (261C), through both linear translation and rotation, decrease the angle of the rocker arm's (127) rotation as the cam track is moved away from the first axis (751). In FIG. 8, the angles are purposefully overlapped for illustration. The traversal distance L remains constant in all three positions of the cam track (261A), (261B) and (261C), but the angle is clearly changed.

As the adjustment arm (251) is fixed to the rocker arm (127), the angular distance traversed by the rocker arm (127) corresponds to the angular distance traversed by the adjustment arm (251). Because of the positional relationship between the adjustment arm (251) and the rocker arm (127), the vertical displacement of the distal end (705) of the rocker arm (127) generally corresponds to the horizontal displacement of the distal end of the adjustment arm (251). As should be clear, the greater the horizontal movement of the distal end (551) of the adjustment arm (251), the more movement that is imparted to the footskate (501) to increase the elliptical motion. The adjustment arm (251) is of fixed length, therefore because its length is not adjustable, the actual horizontal and vertical distance it traverses is based entirely on the angular displacement.

As the cam track (261) is moved toward or away from the first axis, the rocker arm (127) moves through differing angles which in turn means that the adjustment arm (251) is moved through differing angles and its distal end (551) moves a different distance. As the cam track (261) is moved away from the first axis, the rocker arm (127) moves though a smaller angle which in turn means that the adjustment arm (251) is moved through a smaller angle and the distal end (551) moves through a smaller distance. In FIG. 7, the cam track (261) has been tilted away from the first axis (751). While in FIG. 6 the cam track (261) is tilted toward the first axis (751). The movement of the distal end (551) of the adjustment arm (251) is in turn directly related to the movement of the footskate (501) by the transfer arm (253) which serves to transfer some of the movement. In this case, movement of the cam track (261) results in a change in the horizontal sliding motion of the footskate (501).

Figure 5A:
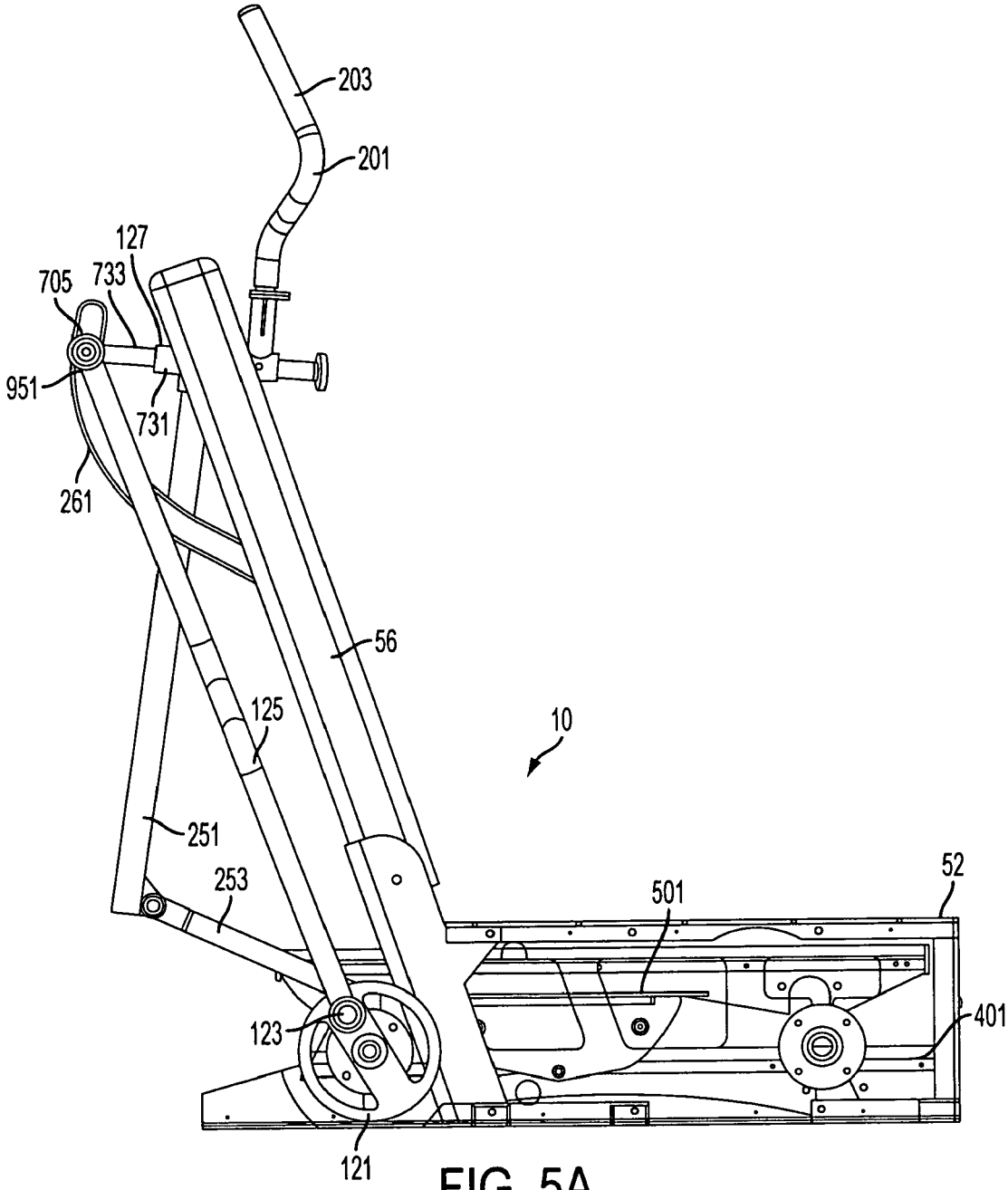
Figure 5B:
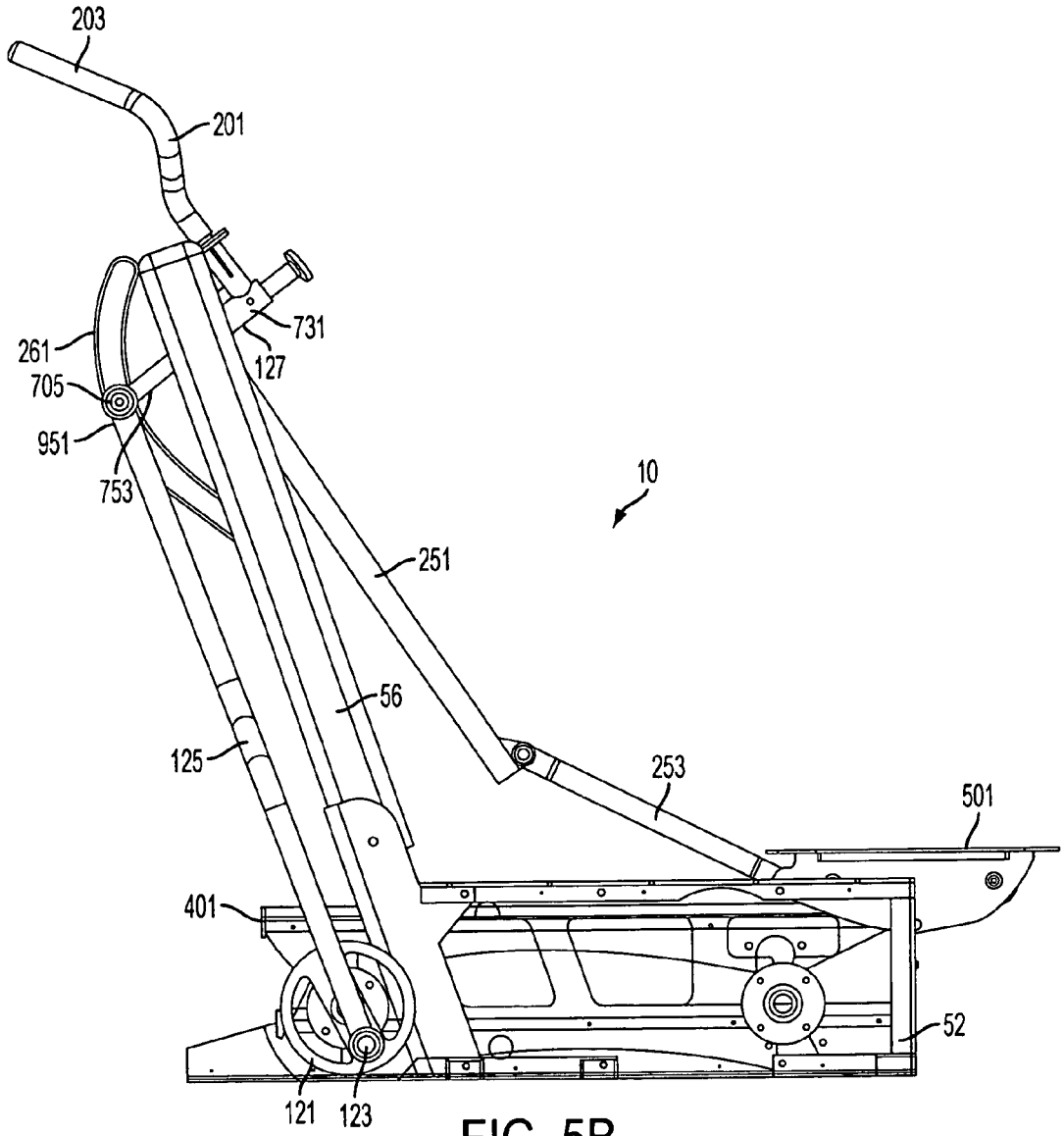
FIG. 5B is a long stride length.

As should be clear from the simplified drawings of FIGS. 6 through 8, the cam track (261) provides for the footskate (501) to be provided with an alterable reciprocation on the rail (401) by adjustment of the path of the distal end of the rocker arm (127) and the angular displacement of the adjustment arm (251). In particular, the greater the horizontal rise of the distal end (705) of the rocker arm (127), the greater the horizontal rotation of the adjustment arm (251) which in turn generally corresponds to a greater reciprocation of the footskate (501). FIGS. 5A and 5B show the effect of the movement with two positions of the cam track (261) using a partial representation of the machine (10) of FIGS. 2 and 3.

To alter the stride length of the exercise, there is included an interface between the adjustment arm (251) and the footskate (501) which, in the depicted embodiment, is a transfer arm (253). The interface serves to transfer the horizontal component of the adjustment arm's (251) distal end's reciprocation to the footskate (501). The transfer arm (253) is rotationally connected between the distal end (255) of the adjustment arm (251) and to the footskate (501) in a manner such that the horizontal component of the adjustment arm's (251) motion is generally translated to the footskate (501). As should be apparent, as the reciprocation of the rocker arm (127) is related to the rotation of the front crankshaft (101), and the reciprocation of the adjustment arm (201) is in turn related to the reciprocation of the rocker arm (127) and the reciprocation of the adjustment arm (251) is in turn related to the translation of the footskate (501), the footskate (501) will oscillate on the main drive link (401) in a relatively fixed timing relationship with the rotation of the front crankshaft (101). Therefore, the system can provide for a relationship of translation related to the position of motion of the front crankshaft (101). To put this another way, for any selected instant along the rotation of the front crankshaft (101), the instantaneous motion of the footskate (501) is the same regardless of the number of times the rotation is repeated.

With appropriate timing, the reciprocation of the footskate (501) may complement the motion of the main drive link (401) to increase the horizontal dimension of the ellipse, or may work against the reciprocating motion of the main drive link (401) to decrease the horizontal dimension of the ellipse. In the latter case, it may even be possible to alter the major dimension of the ellipse to be in the vertical direction by simply shrinking the horizontal dimension to a value less than the radius of the initial circle. In particular, if one were to select a particular fixed point, the reciprocating motion of the footskate (501) allows the user's foot to traverse a distance across that fixed point so that the user's foot has always moved a particular distance relative to the fixed point for a particular location on the ellipse. As the default motion of the footskate (501) in a fixed position is a circle, the interrelationship will generally be selected so as to have the reciprocation work constructively with the horizontal component of the rotation. In this way the horizontal movement component of the rail (401), at any moment, is in the same instantaneous direction as the horizontal component of the adjustment arm (251).

This reciprocating motion of the adjustment arm (251), provides for an arrangement that provides for elliptical as opposed to circular motion for the user's feet. At the same time, once this relationship is determined (which is generally based on the positioning of the offset pin (123)), the adjustment mechanism allows the length of the exercise to become adjustable.

To adjust the dimensions of the exercise in the embodiment of FIGS. 2 and 3, the machine (10) of the depicted embodiment provides for adjustment of the cam track (261) as shown in the FIGS. In particular, as can be seen in the FIGS., the cam tracks (261) for both sides are mounted as a singular cam rotator (267) with the cam track (261) for each adjustment arm (251) being attached together by a central support bar (269). The cam rotator (267) can be adjusted by the placement of an adjustment mechanism (90) which is designed to allow the central support bar (269), and therefore the cam tracks (261) to move toward and away from the top crossbeam (58) and first axis (751) and rotate about the second axis (753). The adjustment mechanism (90) may be any type of machine, but in the preferred embodiment may be a hydraulic or pneumatic piston, worm screw, linear actuator, or other translation device which is in turn powered by an electric or other engine. The engine may be powered by electricity generated by the user's performance of the exercise, or may be from an external source. In an alternative embodiment, the adjustment mechanism (90) may include a hand crank or any other type of hand driven device.

The cam rotator (267) may be provided inside of the cover (13) so as to protect the user from the movement of the cam rotator (267) and to make sure that extraneous materials such as nearby obstructions cannot get in the path of the cam rotator's (267) movement. This is, however, by no means required and the cam rotator (267) may be external to the cover (13) as shown in FIG. 1. The adjustment mechanism (90) can preferably be used by the machine (10) in conjunction with the exercise being performed to provide for "on-the-fly" adjustment of the stride. This in-exercise adjustment allows for increased functionality of the machine (10), comfort for the user, and control over the available exercise options.

In an embodiment, the machine (10) will utilize the adjustable stride via the control panel (72) which will be used to select exercise characteristics. Generally, the user will preselect a program of exercise which corresponds to various different types of motion to be performed according to a pattern, over time, and the control panel (72) will adjust the stride length and resistance device (371) to provide for different types of comfortable motion at different times in the exercise program.

In an exemplary exercise program, the user may start off with a warm up period of light walking, then go into an alternating period of fast running and slower climbing, and then end with a period of slower cool down. The device can create this exercise by beginning with a period of intermediate stride length at a relatively low speed of rotation and low resistance. This would conform more to a quick walk. The user can then be instructed to speed up the stride and as the user's stride begins to accelerate, the machine can adjust the stride length to be longer and lower the resistance. Further, as the length is increasing, the user will naturally wish to adopt a more comfortable, and faster, motion. This would conform more to a running motion. The user can then be instructed to slow up their stride as the machine starts to decrease the stride length and in fact may reduce the stride length to a more circular motion while increasing the resistance. This provides for a more of a climbing motion. As the user enters the cool down section, the stride length can again be adjusted more toward the middle stride length or walking motion again.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. An elliptical exercise machine comprising:

a frame;

at least two crankshafts rotationally connected to said frame;

a left rail attached to both of said crankshafts so that said left rail traverses a path in conjunction with the rotation of said crankshafts;

a right rail attached to both of said crankshafts so that said right rail traverses a path in conjunction with the rotation of said crankshafts;

a left footskate capable of reciprocating motion on said left rail;

a right footskate capable of reciprocating motion on said right rail;

a cam track, said track describing a path;

a left rocker arm, said left rocker arm being arranged to oscillate about a first axis through a first angular distance as said crankshafts rotate, said left rocker arm having a distal end wherein said distal end traverses said path as said left rocker arm oscillates; and a right rocker arm, said right rocker arm being arranged to oscillate about said first axis through a second angular distance as said crankshafts rotate, said right rocker arm having a distal end wherein said distal end traverses said path as said right rocker arm oscillates;

a left adjustment arm, said left adjustment arm connected to said left rocker arm such that said left adjustment arm moves through a third angular distance as said left rocker arm oscillates, said third angular distance being related to said first angular distance;

a right adjustment arm, said right adjustment arm connected to said right rocker arm such that said right adjustment arm moves through a fourth angular distance as said left rocker arm oscillates, said fourth angular distance being related to said second angular distance;

wherein, said left adjustment arm is operationally attached to said left footskate via an interface located toward the distal end of said left adjustment arm in a manner so that reciprocation of said left adjustment arm through said third angular distance provides said reciprocating motion to said left footskate;

wherein, said right adjustment arm is operationally attached to said right footskate via an interface located toward the distal end of said right adjustment arm in a manner so that reciprocation of said right adjustment arm through said fourth angular distance provides said reciprocating motion to said right footskate;

wherein said cam track is moveable; and wherein movement of said cam track between two different positions alters said first angular distance.

2. The machine of claim 1 wherein said movement of said cam track is rotation of said cam track about a second axis spaced from the first.

3. The machine of claim 2 wherein said second axis is on said path.

4. The machine of claim 1 wherein said left rocker arm or said right rocker arm is a sideways pendulum.

5. The machine of claim 4 wherein said left adjustment arm or said right adjustment arm is an upright pendulum.

6. The machine of claim 1 further comprising an adjustment mechanism for moving said cam track between said two positions.

7. The machine of claim 6 wherein said adjustment mechanism is electrically powered.

8. The machine of claim 6 wherein said adjustment mechanism includes a worm screw.

9. The machine of claim 6 wherein said adjustment mechanism includes a hydraulic cylinder.

10. The machine of claim 6 wherein at least one of said crankshafts is attached to a flywheel.

11. The machine of claim 6 wherein at least one of said crankshafts is attached to a resistance device.

12. The machine of claim 11 further comprising a computer to control said machine.

13. The machine of claim 12 wherein said computer can control said resistance device and said adjustment mechanism.

14. The machine of claim 6 wherein said adjustment mechanism is hand powered.

15. The machine of claim 1 wherein at least one of said crankshafts includes a wheel and an offset pin, said offset pin being rotationally connected to a drive link; said drive link being operatively connected to said left rocker arm or said right rocker arm such that: rotation of said wheel causes said drive link to reciprocate which in turn causes the same said rocker arm to oscillate.

16. The machine of claim 1 wherein the position of said left rail or said right rail, at any selected point of rotation, is parallel to the position of the same said rail at any other selected point of rotation.

17. The machine of claim 1 wherein said movement of said cam track is translation of said cam track toward and away from said first axis.

18. The machine of claim 17 wherein said translation is a linear translation.

19. A method of altering the stride length of an elliptical exercise machine during an exercise, the method comprising:

providing an elliptical exercise machine; the machine including:

a frame;

at least two crankshafts rotationally connected to said frame;

a left rail attached to both of said crankshafts so that said left rail traverses a path in conjunction with the rotation of said crankshafts;

a right rail attached to both of said crankshafts so that said right rail traverses a path in conjunction with the rotation of said crankshafts;

a left footskate capable of reciprocating motion on said left rail;

a right footskate capable of reciprocating motion on said right rail;

a cam track, said track describing a path;

a left rocker arm, said left rocker arm being arranged to oscillate about a first axis and through a first angular distance as said crankshafts rotate, said left rocker arm having a distal end wherein said distal end traverses said path as said left rocker arm oscillates; and a right rocker arm, said right rocker arm being arranged to oscillate about a first axis and through a second angular distance as said crankshafts rotate, said right rocker arm having a distal end wherein said distal end traverses said path as said right rocker arm oscillates;

a left adjustment arm, said left adjustment arm connected to said left rocker arm such that said left adjustment arm moves through a third angular distance as said left rocker arm oscillates, said third angular distance being related to said first angular distance;

a right adjustment arm, said right adjustment arm connected to said right rocker arm such that said right adjustment arm moves through a fourth angular distance as said right rocker arm oscillates, said fourth angular distance being related to said first angular distance; and attaching said left adjustment arm to said left footskate via an interface located toward the distal end of said adjustment arm in a manner so that reciprocation of said left adjustment arm through said third angular distance provides said reciprocating motion to said left footskate;

attaching said right adjustment arm to said right footskate via an interface located toward the distal end of said adjustment arm in a manner so that reciprocation of said right adjustment arm through said fourth angular distance provides said reciprocating motion to said right footskate; and changing the position of said cam track during said exercise.

* * * * *